US005178113A

United States Patent [19]

Lott et al.

[11] Patent Number: 5,178,113

[45] Date of Patent: Jan. 12, 1993

[54] ADJUSTER FOR A THROTTLE DEVICE OF AN INTERNAL COMBUSTION ENGINE

[75] Inventors: Thomas Lott, Buehl-Vimbuch; Peter-Josef Bauer, Buehl; Torsten Janke, Buehlertal, all of Fed. Rep. of Germany

[73] Assignee: Robert Bosch GmbH, Stuttgart, Fed. Rep. of Germany

[21] Appl. No.: 838,975

[22] Filed: Feb. 21, 1992

[30] Foreign Application Priority Data

Mar. 6, 1991 [DE] Fed. Rep. of Germany ..... 4107053

[51] Int. Cl.[5] ..... F02D 7/00

[52] U.S. Cl. ..... 123/399; 123/361

[58] Field of Search ..... 123/399, 361, 339, 352; 180/178, 179

[56] References Cited

U.S. PATENT DOCUMENTS

| | | | |
|---|---|---|---|
| 4,192,398 | 3/1980 | Hunt | 123/361 |
| 4,212,272 | 7/1980 | Hawk | 123/361 |
| 4,363,303 | 12/1982 | Takayama | 123/339 |
| 4,436,069 | 3/1984 | Collonia | 123/361 |
| 4,455,978 | 6/1984 | Atago et al. | 123/361 |
| 4,539,955 | 10/1985 | Wilson et al. | 123/361 |
| 4,655,180 | 4/1987 | Bauer et al. | 123/361 |
| 5,048,485 | 9/1991 | Terazawa et al. | 123/399 |
| 5,121,727 | 6/1992 | Kramer et al. | 123/399 |

FOREIGN PATENT DOCUMENTS

| | | | |
|---|---|---|---|
| 3519324 | 12/1986 | Fed. Rep. of Germany | 123/399 |

*Primary Examiner*—Raymond A. Nelli

*Attorney, Agent, or Firm*—Edwin E. Greigg; Ronald E. Greigg

[57] ABSTRACT

An adjuster for a throttle device of an internal combustion engine in which a switch tappet is guided in an actuating tappet in such a way that external forces are not exerted upon it, which prevents any problems to the switch performance. The adjuster is embodied such that the switch performance is easily adjustable and is protected against external influences. The adjuster has an actuating tappet, formed of a guide body and a switch socket, in which a switch is disposed. The switch socket is displaceably supported in the guide body with a guide shoulder counter to the force of a restoring spring and it guides a switch tappet, which is aligned with the switch and which is threaded to a variable depth into the switch socket in order to adjust the switch point. Any external forces act upon an actuating body supported in the switch socket. The adjuster is used to adjust the position of a throttle device in the intake tube of an engine.

4 Claims, 2 Drawing Sheets

ADJUSTER FOR A THROTTLE DEVICE OF AN INTERNAL COMBUSTION ENGINE

BACKGROUND OF THE INVENTION

The invention is based on an adjuster as defined hereinafter. In a known adjuster of this type (German Offenlegungsschrift 35 19 324), installing the actuating tappet in general and setting the switching point of the electric switch in particular are complicated and expensive.

OBJECT AND SUMMARY OF THE INVENTION

The adjuster according to the invention has the advantage over the prior art that the actuating tappet is easy to install and the switching point of the electric switch is simple to set, without increasing the length of the outer sheathing of the adjuster. It is especially advantageous that forces of the throttle device, acting upon the actuating tappet, engage the switch socket but not the switch tappet, which prevents canting of the switch tappet.

It is advantageous that the restoring spring is disposed in the guide opening and rests at one end on the guide shoulder of the switch socket and with its other end on a retaining shoulder of the guide body, so that the switch tappet is not canted by a skewed restoring spring.

It is especially advantageous to provide the switch socket with a switch head provided with yielding detent tongues, which protrude past the guide body and extend behind a detent collar, engaging it; as a result, the switch socket is retained on the guide body, and the axial mobility of the switch socket relative to the guide body is limited.

It is also advantageous to insert an actuating body into the switch head, one end of this body being engaged by a lever of the throttle device, and a sleeve projection being provided on the other end, the projection protruding partway past the switch tappet and serving as an axial securing means for the position of a sealing ring disposed on the switch tappet.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
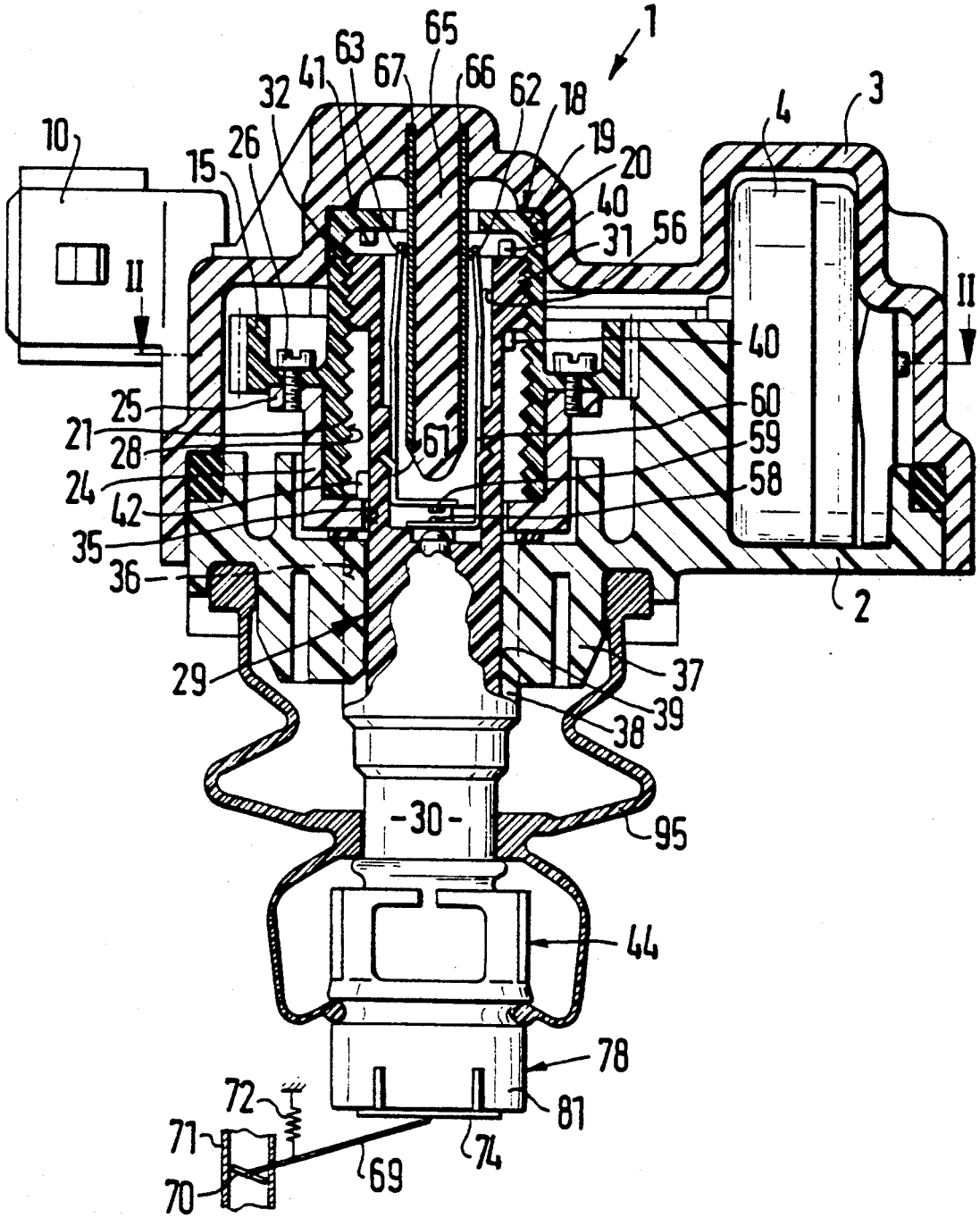
FIG. 1 is a section through an adjuster taken along the line I—I of FIG. 2.
Figure 2:
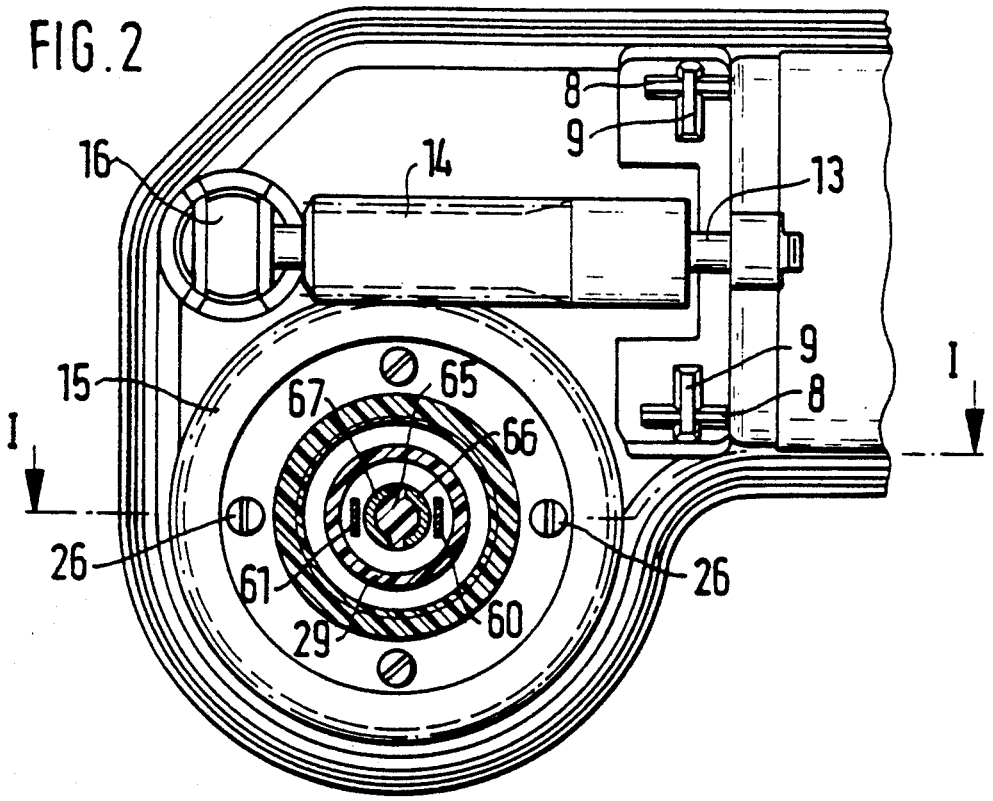
FIG. 2 is a section taken along the line II—II of FIG. 1.
Figure 3:
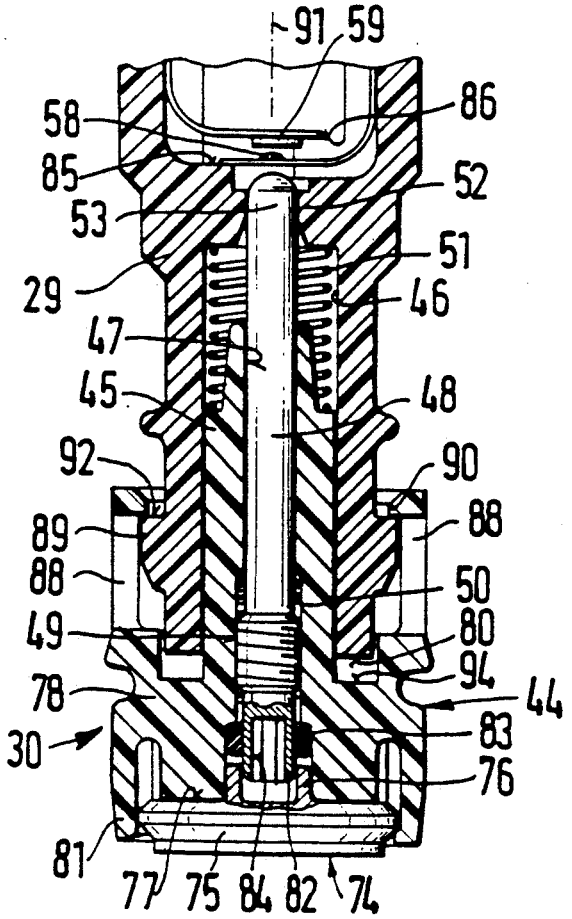
FIG. 3 is a section through the actuating tappet of the adjuster, on a different scale.

The adjuster 1 shown in FIGS. 1-3 includes a housing having a bottom part 2 and a cover 3. An electric motor 4 is disposed in the bottom part 2. The electrical connection of the electric motor 4 is effected via connection tongues 8, which can be provided with electrical contact via contact conductors 9. The contact conductors 9 lead to a plug 10, which can be electrically connected to an electronic control unit, not shown. A worm 14, which meshes with a worm wheel 15 and with it forms a gear, is connected to a drive shaft 13 of the electric motor 4. The end of the drive shaft 13 remote from the electric motor is rotatably supported in a bearing body 16. For supporting the work wheel, a hub 18 of the worm wheel 15 protrudes with a bearing shoulder 19 into a bearing opening 20 of the cover 3. The hub 18 has an extension shoulder 21, which is disposed on the side of the worm wheel 15 remote from the bearing shoulder 19. A cap 24 is mounted on the extension shoulder 21, resting by a flange 25 on the worm wheel 15 and being secured to the worm wheel by screws 26. The hub 18 of the worm wheel 15 has an internal thread 28, into which a guide body 29 of an actuating tappet 30 protrudes with a threaded portion 31 that is provided with an external thread 32 cooperating with the internal thread 28 of the hub 18. By its end remote from the threaded portion 31, the guide body 29 protrudes through an opening 35 of the cap 24 and through a guide opening 36 of a connection neck 37 of the bottom part 2. At least one guide groove 38 extending axially is embodied on the circumference of the guide body 29, and it is engaged on the inside by a rib 39, formed on the guide opening 36 of the connection neck 37, in such a way that the guide body 29 is displaceably supported, but secured against torsion, in the guide opening 36. In the present exemplary embodiment, there are two guide grooves 38 in the guide body 29 and two ribs 39 in the guide opening 36. If the worm wheel 15 is turned by the worm 14, the guide body 29 and thus the actuating tappet 30 are thereby shifted more or less out of the worm wheel 15, because of the external thread 32 engaging the internal thread 28. To prevent wedging or seizing of the guide body 29 relative to the worm wheel 15 beyond the structurally set displacement path of the guide body 29 in the event of unintentional or improper operation, a stop protrusion 40 is disposed on each end of the threaded portion 31. A stop protrusion 41 is also provided on the bearing shoulder 19 of the hub 18, and a further stop protrusion 42 is provided on the cap 24. The stop protrusions 40/41 and 40/42 each come to engage one another in the specified structural terminal positions of the guide body 29 and block any further displacement motion, without causing any seizing between the worm wheel 15 and the guide body 29. The actuating tappet 30 also has a switch socket 44, which has a guide shoulder 45 that is displaceably supported in a guide opening 46 of the guide body 29 and protrudes out of the connection neck 37.

A switch tappet 48 is guided with narrow play in an axially extending, stepped through opening 47 of the switch socket 44 and is screwed by an externally threaded portion 49 into an internally threaded portion 50 of the through opening 47. A restoring spring 51 is disposed in the guide opening 46, supported by one end on the guide shoulder 45 and by the other on a retaining shoulder 52 of the guide body 29. Remote from the externally threaded portion 49, the switch tappet 48 protrudes out of the guide shoulder 45 with a contact end 53 and is oriented, penetrating the restoring spring 51 and the retaining shoulder 52, toward an electric switch, which is embodied of a first switch contact 58 and a second switch contact 59 and which is closeable upon a displacement motion of the tappet 48 toward the first switch contact 58, counter to the force of the restoring spring 51. The first switch contact 58 is connected to a first electric conductor 60, and the second electric switch contact 59 is connected to a second electric conductor 61. The electric conductors 60, 61 are guided and held, facing one another, in a bore 56 of the guide body 29. The first electric conductor 60 ends at a first wiper prong 62, and the second electric conductor 61 ends at a second wiper prong 63. A tang 65 formed on the cover 3 protrudes into the bore 56 of the guide body 29 and carries a first electrically conductive contact track 66 and a second electrically conductive contact track 67, which are insulated from one another. On their other ends, the contact tracks 66, 67 lead to the plug 10. The first wiper prong 62 rests positively on the first contact track 66, and the second wiper prong 63 rests positively on the second contact track 67. Thus upon an axial displacement of the guide body 29, the electric contact between the wiper prongs 62, 63 and the contact tracks 66, 67, respectively, can be maintained.

The actuating tappet 30 is oriented toward a stop, for instance embodied as a lever 69, of a throttle device 70, for instance a throttle valve disposed in the intake tube 71 of an internal combustion engine. The lever 69 is acted upon in the direction of the actuating tappet 30 by a spring 72, by means of which it is kept in contact with an actuating body 74 of the actuating tappet 30. The actuating body 74 is embodied of a wear- and impact-resistant material with a low coefficient of friction, for example of plastic, and has a disk-shaped head 75 and a sleeve projection 76. With its disk-shaped head 75, the actuating body 74 rests on a stop face 77 of a switch head 78 of the switch socket 44; the switch head 78 adjoins the guide shoulder 45 directly, and outside the guide opening 46 of the guide body 29 it is larger in diameter than an end face 80 of the guide body 29. Retaining tongues 81 are formed on the switch head 78, fitting around the circumference of the actuating body 74 on the head 75 and with it creates a detent connection by which the head 75 is held firmly against the contact face 77. The sleeve projection 76 of the actuating body 74 protrudes into the stepped through opening 47 and fits partway over a cylindrical adjusting end 82 of the switch tappet 48, on which a sealing ring 83 is disposed, located on the outside of the through opening 47, the axial displaceability of the sealing ring being limited by the sleeve extension 76. A hexagonal socket 84 is for instance formed in the adjusting end 82 of the switch tappet 48, and this socket can be engaged by a tool when the head 75 has been removed, in order to screw the switch tappet 48 into the switch socket 44 to a variable depth, by means of which the switch point of the switch 58, 59 is adjusted exactly. If the contact end 53 of the switch tappet 48 is spaced from the first switch contact 58, then the first switch contact 58 rests on a first bearing shoulder 85, and the second switch contact 59 rests on a second bearing shoulder 86 of the guide body 29.

On the switch head 78 of the switch socket 44, detent tongues 88 are formed extending in the direction opposite that of the retaining tongues 81; the detent tongues extend past the end face 80 of the guide body 29 to beyond a detent collar 89 of the guide body 29, and with detent protrusions 90 they rest on a flat detent face 92 of the detent collar 89 oriented toward the bottom part 2 and extending at right angles to the longitudinal axis 91 of the guide body 29. The contact of the detent protrusions 90 with the detent face 92 is effected by the force of the restoring spring 51 upon the switch socket 44. In this position, a spacing exists in the axial direction between the end face 80 of the guide body 29 and a bottom face 94, oriented toward the end face 80, of the switch head 78; this spacing enables displacement of the switch socket 44, along with the switch tappet 48, toward the switch 58, 59. A sealing cuff 95 is secured to the bottom part 2, surrounding the actuating tappet 30 with little axial exertion of force as far as the switch head 78 and being held thereon. When the lever 69 of the throttle device rests on the actuating body 74, the switch socket 44 and thus the switch tappet 48 are displaced counter to the force of the restoring spring 51, and as a result the contact end 53 closes the switch 58, 59 and thus closes an electrical current circuit carried via the electronic control unit which controls the motor 4.

Upon triggering of the electric motor 4, the drive shaft 13 is rotated, and the worm 14 turns the worm wheel 15, so that the guide body 29 executes an axial motion that variably adjusts the lever 69 in the opening direction of the throttle device 70. This kind of adjustment of the lever 69 for controlling the throttle device 70 can for instance be done in order to regulate engine idling with the throttle device 70, or to enable so-called cold starting enrichment in cold starting of the engine.

Because of the retention of the switch tappet 48 inside the switch socket 44, it is possible to prevent external forces acting upon the switch socket 44 from impairing the switching behavior of the switch tappet 48. In addition to the bottom part 2 and the cover 3 of the housing, it is possible for the guide body 29, switch socket 44, actuating body 74 and switch tappet 48, among others, to be made from plastic; as a result, high-precision parts can be produced that do not require subsequent costly machining. Plastic materials should be selected that compensate for any influence on the switch point of the switch 58, 59 from thermal influences. The embodiment of the adjuster makes simple assembly possible.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An adjuster for a throttle device of an internal combustion engine, having a housing and an actuating tappet that is adjustable by an electric motor via a gear, the tappet having a guide body and a switch tappet supported displaceably in the guide body counter to a restoring spring, by means of said tappet an electric switch disposed in the guide body is actuatable, the guide body (29) has a guide opening (46), in which a switch socket (44) is displaceably supported with a guide shoulder (45), and the switch socket (44) has an axially extending, stepped through opening (47) with an internally threaded portion (50), into which an externally threaded portion (49) of the switch tappet (48) is threaded, said tappet is guided with a narrow play in the through opening (47) and protrudes out of the guide shoulder (45) into the guide opening (46) with a contact end (53) oriented toward the switch (58, 59).

2. An adjuster as defined by claim 1, in which the restoring spring (51) is disposed in the guide opening (46) and rests by one end on the guide shoulder (45) of the switch socket (44) and by the other end on a retaining shoulder (52) of the guide body (29).

3. An adjuster as defined by claim 1, in which the switch socket (44) has a switch head (78) that adjoins the guide shoulder (45) and is provided with yielding detent tongues (88) that extend behind and engage a detent collar (89) of the guide body (29).

4. An adjuster as defined by claim 3, in which an actuating body (74) is inserted into the switch head (78), protruding partway past the switch head (48) with a sleeve projection (76) and serves to axially secure the position of a sealing ring (83) disposed on the switch tappet (48).

* * * * *